US005084191A

United States Patent [19]

Nagase et al.

[11] Patent Number: 5,084,191

[45] Date of Patent: Jan. 28, 1992

[54] WATER- AND OIL-REPELLENT TREATMENT AGENT

[75] Inventors: Makoto Nagase, Hachioji, Japan; Kathy Allewaert, Heverlee, Belgium; Franceska Fieuws, Brugge, Belgium; Dirk Coppens, Antwerpen, Belgium

[73] Assignee: Minnesota Mining and Manufacturing Company, St. Paul, Minn.

[21] Appl. No.: 624,604

[22] Filed: Dec. 10, 1990

[30] Foreign Application Priority Data

Dec. 22, 1989 [JP] Japan ..... 1-334621

[51] Int. Cl.[5] ..... D06M 10/08; C08K 5/34; C09D 5/20

[52] U.S. Cl. ..... 252/8.6; 252/8.7; 252/8.8; 252/8.9; 106/2; 524/87

[58] Field of Search ..... 252/8.6, 8.7, 8.75, 252/8.8 R, 8.9; 106/2; 524/87

[56] References Cited

U.S. PATENT DOCUMENTS

| | | | |
|---|---|---|---|
| 3,256,231 | 6/1966 | Johnson et al. | 260/29.6 |
| 3,282,905 | 11/1966 | Fasick et al. | 260/89.5 |
| 3,341,497 | 9/1967 | Sherman et al. | 260/72 |
| 3,412,179 | 11/1968 | Kleiner | 260/900 |
| 3,420,697 | 1/1969 | Sweeney et al. | 117/121 |
| 3,445,491 | 5/1969 | Pacini | 260/399 |
| 3,470,124 | 9/1969 | Van Eygen et al. | 260/29.6 |
| 3,544,537 | 12/1970 | Brace | 260/89.5 |
| 3,546,187 | 12/1970 | Tandy | 260/80.76 |
| 3,639,144 | 2/1972 | Chance et al. | 117/56.8 |
| 3,901,727 | 8/1975 | Loudas | 134/4 |
| 3,922,143 | 11/1975 | Schuster et al. | 8/94.21 |
| 3,931,080 | 1/1976 | Hammer et al. | 260/29.4 |
| 3,968,066 | 7/1976 | Muellen | 524/87 |
| 4,004,059 | 1/1977 | Delmer et al. | 428/224 |
| 4,054,592 | 10/1977 | Dear et al. | 560/25 |
| 4,145,303 | 3/1979 | Loudas | 252/156 |
| 4,215,205 | 7/1980 | Landucci | 525/331 |
| 4,426,466 | 1/1984 | Schwartz | 523/455 |
| 4,468,527 | 8/1984 | Patel | 564/96 |
| 4,477,498 | 10/1984 | Deiner et al. | 427/389.9 |
| 4,540,497 | 9/1985 | Chang et al. | 252/8.8 |
| 4,560,487 | 12/1985 | Brinkley | 252/8.75 |
| 4,566,981 | 1/1986 | Howells | 252/8.8 |
| 4,606,737 | 8/1986 | Stern | 8/115.6 |
| 4,668,406 | 5/1987 | Chang | 252/8.75 |

FOREIGN PATENT DOCUMENTS

| | | |
|---|---|---|
| 67-129077 | | Japan . |
| 59-21778 | 2/1984 | Japan . |

OTHER PUBLICATIONS

Banks, R. E., "Organofluorine Chemicals and their Industrial Applications", Ellis Horwood Ltd., Chichester, England, 1979, pp. 226–234.

*Primary Examiner*—Paul Lieberman
*Assistant Examiner*—William S. Parks
*Attorney, Agent, or Firm*—Gary L. Griswold; Walter N. Kirn; Carole Truesdale

[57] ABSTRACT

Compositions for imparting water- and oil-repellency to fabrics and provided. The compositions contain a flurochemical water- and oil-repellent agent, an aziridine compound, and a metal alcoholate or ester. The compositions may optionallly contain a silicone water-repellent agent.

19 Claims, No Drawings

WATER- AND OIL-REPELLENT TREATMENT AGENT

The present invention relates to a fluorine-type, or fluorochemical, water- and oil-repellent treating agent, useful for products having fibrous substrates such as silk, wool, cotton, leather, hemp, rayon and the like, and having improved performances.

It is hitherto well known that certain fluorochemical compounds exhibit excellent performances as water- and oil-repellent treating agents for woven fabrics or the like.

The use of various fluorochemical compositions on fibers and fibrous substrates, such as textiles, paper, and leather, to impart oil and water repellency is known. See, for example, Banks, Ed., *Organofluorine Chemicals and Their Industrial Applications,* Ellis Horwood Ltd., Chichester, England, 1979, pp. 226–234. Such fluorochemical compositions include, for example, fluorochemical guanidines (U.S. Pat. No. 4,540,497, Chang et al.), compositions of cationic and non-cationic fluorochemicals (U.S. Pat. No. 4,566,981, Howells), compositions containing fluorochemical carboxylic acid and epoxidic cationic resin (U.S. Pat. No. 4,426,466, Schwartz), fluoroaliphatic carbodiimides (U.S. Pat. No. 4,215,205, Landucci), and fluoroaliphatic alcohols (U.S. Pat. No. 4,468,527, Patel).

Japanese Patent laid-open No. 59-21778 discloses compositions comprising certain fluorine containing polymers and certain polyfunctional aziridines. These compositions are said to impart water and oil repellency to fabrics, and to retain this repellency after washing or dry-cleaning. Furthermore, these compositions are said to impart these desired properties without necessarily heat treating.

Now, water- and oil-repellent treatment, or treating, agents for fabrics of kimono (Japanese clothes), especially woven fabrics of 100% silk are required to have the following features or performances:

1) High water- and oil-repellency;

2) Dry cleaning resistance, that is, retention of oil and water repellency after dry cleaning; 3) Retention of soft feeling or hand essential to silk after water- and oil-repellent processing;

4) One-pack type processing solution (solely imparting the above-mentioned performances) without requiring any processing assistant; and 5) Safety, particularly low skin irritancy.

Conventional water- and oil-repellent treatment agents, however, have various problems since silk is inferior to other fibers in chemical, heat resistance and the like. Therefore, treatment agents satisfying all the aforementioned performance requirements have not been available.

An object of the present invention is to provide a one-pack (or single composition) type water- and oil-repellent treating agent capable of imparting high water repellency, dry cleaning resistance, and soft feeling or hand to silk and other fibrous substrates by a simple processing means that does not require heat treating.

Briefly, in one aspect, the present invention provides a treating agent capable of producing sufficient water- and oil- repellent effects by treating fibrous substrates such as silk, at a relatively low temperature. Surprisingly, it has been found that sufficient water- and oil-repellent effects are obtained by treatment of the substrate followed by drying to remove solvent at a relatively low temperature of 90° C. or below.

In another aspect, the treating agents of the present invention, through addition of a metallic ester or alcoholate to a combination of a fluorine-type or fluorochemical water- and oil-repellent agent and an aziridine compound impart desired oil and water-repellency to silk or other fibrous substrates without impairing soft feeling or hand essential to the silk and other fibrous substrates.

Thus, the present invention provides a water- and oil-repellent treating agent comprising a fluorine-type or fluorochemical water- and oil-repellent agent, an aziridine type compound, and a metallic ester or alcoholate. This invention also provides fabrics, for example, silk, and other textile products, treated with the composition of the present invention, that retain oil and water repellency after dry-cleaning. It is not necessary to heat treat the fibrous substrate in order to obtain the desired oil- and water-repellency.

Surprisingly, it has also been found that the composition of the present invention is capable of further imparting soft feeling or hand essential to silk and other fibrous substrates by adding optional silicone products, such as silicone-type water-repellent agents, without impairing oil repellency thereof at all. Silicone-type water repellent agents have hitherto been regarded as deteriorating oil repellency.

An important feature of the treating agent of the present invention is that any type of the fluorine-type or fluorochemical, water- and oil-repellent agents which are commercially available products may be used. Any of the known fluoroaliphatic radical-containing agents useful for the treatment of fabrics to obtain oil and water-born stain repellency can be used including condensation polymers such as polyesters, polyamides, polyepoxides and the like, and vinyl polymers such as acrylates, methacrylates, polyvinyl ethers and the like. Such known agents include for example, U.S. Pat. No. 3,546,187 (Oil-and Water-Repellent Polymeric Compositions); U.S. Pat. No. 3,544,537 (Fluorochemical Acrylate Esters And Their Polymers); U.S. Pat. No. 3,470,124 (Fluorinated Compounds); U.S. Pat. No. 3,445,491 (Perfluoroalkylamido-Alkylthio Methacryles And Acrylates); U.S. Pat. No. 3,420,697 (Fluorochemical Polyamides); U.S. Pat. No. 3,412,179 (Polymers of Acrylyl Perfluorohydroxamates); and U.S. Pat. No. 3,282,905 (Fluorochemical Polyesters). Further examples of such fluoroaliphatic radical-containing water- and oil- repellent agents include those formed by the reaction of fluoroaliphatic thioglycols with diisocyanates to provide perfluoroaliphatic group-bearing polyurethanes. These products are normally applied as aqueous dispersions for fiber treatment. Such reaction products are described, for example, in U.S. Pat. No. 4,054,592. Another group of compounds which can be used are fluoroaliphatic radical-containing N-methylol condensation products. These compounds are described in U.S. Pat. No. 4,477,498. Further examples include fluoroaliphatic radical-containing polycarbodiimides which can be obtained by, for example, reaction of perfluoroaliphatic sulfonamide alkanols with polyisocyanates in the presence of suitable catalysts.

The fluoroaliphatic radical, called $R_f$ for brevity, is a fluorinated, stable, inert, preferably saturated, nonpolar, monovalent aliphatic radical. It can be straight chain, branched chain, or cyclic or combinations thereof. It can contain catenary heteroatoms, bonded only to carbon atoms, such as oxygen, divalent or hexavalent sulfur, or nitrogen. $R_f$ is preferably a fully fluorinated radical, but hydrogen or chlorine atoms can be present as substituents provided that not more than one atom of either is present for every two carbon atoms. The $R_f$ radical has at least 3 carbon atoms, preferably 3 to 20 carbon atoms and most preferably about 4 to about 10 carbon atoms, and preferably contains about 40% to about 78% fluorine by weight, more preferably about 50% to about 78% fluorine by weight. The terminal portion of the $R_f$ radical is a perfluorinated moiety which will preferably contain at least 7 fluorine atoms, e.g., $CF_3CF_2CF_2$—, $(CF_3)_2CF$—, $F_5SCF_2$—, or the like. The preferred $R_f$ radicals are fully or substantially fluorinated and are preferably those perfluorinated aliphatic radicals of the formula $C_nF_{2n+1}$—.

Aziridine compounds useful in this invention include monofunctional and polyfunctional aziridines. Aziridines are compounds which contain at least one moiety which can be represented by the formula:

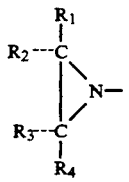

where $R_1$, $R_2$, $R_3$ and $R_4$ are generally H, or lower alkyl, e.g. with 1 to 6 carbon atoms.

Specific examples of aziridine compounds used as components in the treating agents of the present invention include, but are not limited to, β-aziridinylmethyl methacrylate, N-cyanoethylethylene-imine, octadecylethyleneurea, trimethylolpropanetris-[3-(1-aziridinyl)-propionate], trimethylolpropanetris[3-(1-aziridinyl)butyrate], trimethylolpropane[3-(1-(2-methyl)aziridinyl)-propionate], trimethylolpropanetris[3-(1-aziridinyl)-2-methyl propionate], pentaerythritoltris[3-(1-aziridinyl)-propionate], pentaerythritoltris[3-(1 (2-methyl)-aziridinyl)propionate], diphenylmethane-4,4'-bis N,N'-ethyleneurea, 1,6-hexamethylene-bis-N,N'-ethyleneurea, 2,4,6-(triethyleneimino)-syn-triazine, bis[1-(2-ethyl)-aziridinyl]benzene-1,3-dicarboxylic acid amide and the like. Trimethylolpropane-tri-β-aziridinyl propionate is generally preferred due to low dermal irritancy.

Specific examples of polyfunctional aziridine type compounds include 1,6-hexamethylenediethyleneurea, diphenylmethanebis-4,4'-N,N'-diethyleneurea, 1,1,1-tris-(β-aziridinylpropionyloxymethyl)propane and the like. Such aziridine type compounds may be used alone or two or more thereof may be used in combination.

The amount of the above-mentioned aziridine type compounds used may be selected from a wide range. Disadvantages, however, are caused as follows: if the amount thereof used is small, recovery of water- and oil-repellent performances is deteriorated in dry cleaning of treated silk products; if the amount is large, soft feeling (or hand) of the treated silk products is markedly hardened or water- and oil-repellent performances are deteriorated. Therefore, the amount of the aziridine type compound used is 1 to 20% by weight, preferably 3 to 10% by weight, based on the weight of the fluorochemical.

The metallic esters or alcoholates employed in the present invention are those that are capable of imparting improved water and oil repellency and dry cleaning resistance to fabrics, such as, silk, by treating at a relatively low temperature of 90° C. or below, including room temperature. The metallic esters or alcoholates employed in the present invention are those that in combined use (or admixture) with fluorochemical agent and aziridine compound may be used for treating fibrous substrates without impairing soft feeling or hand essential to the substrate. Zirconium or aluminum metallic esters or alcoholates are preferred, and titanium type esters or alcoholates are less preferred when possible yellowing is a concern. The metal compounds may be alcoholates, esters, or mixtures thereof. Examples thereof include aluminum isopropylate, mono-sec-butoxyaluminum diisopropylate, aluminum sec-butyrate, aluminum ethylate, aluminum sec-butyrate stearate, zirconium butyrate, zirconium propylate and the like.

The amount of the aforementioned metallic alcoholate or ester used is 10 to 200% by weight, preferably 20 to 100% by weight based on the weight of the fluorochemical.

The compositions of this invention may further comprise silicone compounds. Silicone oils (for example, SH 200, manufactured by Toray Silicone Co., Ltd.) or silicone oil type water repellents (for example, SD 8000, manufactured by Toray Silicone Co., Ltd.), which can be used without yellowing fabrics, are preferably used as the silicone compound added to the water- and oil-repellent treating agent in combined use for the purpose of imparting soft feeling essential to silk products subjected to water- and oil-repellent processing. Such silicone compounds contribute to water repellency without essential oil repellency. However, water repellency is also imparted by addition of silicone compounds to the treating agent without deteriorating the oil repellency imparted to the substrate by the treating agent.

The water- and oil-repellent treating agent of the present invention can be applied using various treating methods such as a solution in a solvent, emulsion or aerosol, but normally used often as a one-pack type solution in a solvent. The solutions are typically, but not limited to, 0.2 to 2% solids. Of more importance is the final % solids on the fibrous substrate after treatment and drying. The % solids on fabric is preferable 0.05 to 3%.

The treatment of silk products using the water- and oil-repellent treating agent of the present invention is carried out by application of the treating agent using well-known methods such as for example dipping, spraying, padding, knife coating, roll coating or the like, drying at 80° C. or below, including room temperature, e.g. about 20° C., and optionally heat-treating the silk products in the same manner as in conventional textile processing methods.

The type of silk products treated by the water- and oil-repellent agent of this invention is not especially limited; however, the products are normally treated in the form of woven fabrics.

The water- and oil-repellent treating agent of the present invention can give excellent effects not only to silk products but also to other fibrous substrates such as those of wool, cotton, hemp, leather products, and synthetic fabrics. In addition, forms of such products include textile fabrics, such as woven, knitted, and nonwoven fabrics.

Numerical values related to compositions of the water- and oil-repellent agent are wholly based on weight unless otherwise noted.

Respective data of water and oil repellency shown in Examples and Comparative Examples are based on the following methods of measurement and evaluation criteria:

First, the water repellency is measured by the spraying method according to the JIS L-1005, and spray evaluation is made at grades of 0 to 100, which is the highest evaluation (see Table 1).

TABLE 1

| Water Repellency No. | Condition |
|---|---|
| 100 | Without adhered wetting or swelling on the surface |
| 90 | Exhibiting slight adhered wetting and swelling on the surface |
| 80 | Exhibiting partial wetting and swelling on the surface |
| 70 | The surface was swollen |
| 50 | The whole surface was swollen |
| 0 | The surface was wholly swollen to the back of the sample |

Oil repellency is measured by a method according to the AATCC-118-1981. Solvents of different surface tension are placed on the sample and the sample is scored according to the solvent of lowest surface tension that does not penetrate the sample. A treated fabric that is not penetrated by Nujol TM, having the lowest penetrating power, is rated as score 1, and a treated fabric that is not penetrated by heptane, having the highest penetrating power in test oils, is rated as score 8 (see Table 2).

TABLE 2

| Oil Repellency No. | Surface tension (dyne/cm) | Standard test liquid |
|---|---|---|
| 0 | — | Less than 1 |
| 1 | 31.45 | Nujol TM |
| 2 | 29.6 | Nujol TM /n-hexadecane = 65/35 (% by weight) |
| 3 | 27.3 | n-Hexadecane |
| 4 | 26.35 | n-Tetradecane |
| 5 | 24.7 | N-Dodecane |
| 6 | 23.5 | n-Decane |
| 7 | 21.4 | n-Octane |
| 8 | 19.75 | n-Heptane |

EXAMPLE 1

Ten percent by weight of a copolymer of 65% by weight of a perfluoroalkylmethacrylate monomer, $C_8F_{17}SO_2N(CH_3)CH_2CH_2O_2CC(CH_3)=CH_2$, and 35% by weight of an alkylmethacrylate monomer, $C_{18}H_{37}O_2CC(CH_3)=CH_2$, 1% by weight of trimethylolpropanetris[3-(1-aziridinyl)-propionate] and 3% by weight of zirconium butyrate were dissolved in 86% by weight of 1,1,1-trichloroethane at ambient temperature, and then diluted 20-fold with mineral spirit to prepare a treating agent. The copolymer was prepared by the method described in Example 6 of U.S. Pat. No. 3,341,496 (Sherman and Smith).

EXAMPLE 2

Ten percent by weight of the copolymer of Example 1, 1% by weight of the aziridine compound of Example 1, 3% by weight of zirconium butyrate and 20% by weight of Silicone oil SH 200 manufactured by Toray Silicone Co., Ltd. were dissolved in 66% by weight of 1,1,1-trichloroethane at ambient temperature, and then diluted 20-fold with mineral spirit to prepare a treating agent.

COMPARATIVE EXAMPLE C1

Ten percent by weight of the copolymer of example 1 was dissolved in 90% by weight of 1,1,1-trichloroethane at ambient temperature to prepare a treating agent.

COMPARATIVE EXAMPLE C2

Ten percent by weight of the copolymer of Example 1 and 20% by weight of the silicone oil of example 2 were dissolved in 70% by weight of 1,1,1-trichloroethane at ambient temperature to prepare a treating agent.

COMPARATIVE EXAMPLE C3

Ten percent by weight of the copolymer of Example 1 and 1% by weight of the aziridine compound of Example 1 were dissolved in 89% by weight of 1,1,1-trichloroethane at ambient temperature to prepare a treating agent.

A standard fabric of 100% for the JIS color fastness test was dipped in the resulting processing solution, squeezed with a mangle and dried at 80° C. in a hot-air dryer for 5 minutes. Test results of the treated fabric are shown in Table 3.

COMPARATIVE EXAMPLE C4

Ten percent by weight of the copolymer of Example 1, 1% by weight of the aziridine compound of Example 1, and 20% by weight of the silicone oil of Example 2 were dissolved in 60% by weight of 1,1,1-trichloroethane at ambient temperature to prepare a treating agent.

TABLE 3

| | | Composition of water- and oil-repellent agent (components ratio) | Water-repellency Initial | Water-repellency After dry cleaning | Initial Oil-repellency | Initial Feeling |
|---|---|---|---|---|---|---|
| Examples | 1 | Copolymer/aziridine metallic (10/1/3) | 100 | 70 | 4 | 3 |
| | 2 | Copolymer/aziridine metallic/SH-200 (10/1/3/20) | 100 | 70 | 4 | 4 |
| Comparative examples | C1 | Copolymer | 80 | 0–50 | 4 | 2 |
| | C2 | Copolymer/SH200 (½) | 80 | 0–50 | 1 | 4 |
| | C3 | Copolymer/aziridine (10/1) | 90 | 70 | 5 | 1 |

TABLE 3-continued

| | Composition of water- and oil-repellent agent (components ratio) | Water-repellency Initial | Water-repellency After dry cleaning | Initial Oil-repellency | Initial Feeling |
|---|---|---|---|---|---|
| C4 | Copolymer/aziridine/SH200 (10/1/20) | 90 | 70 | 4 | 4 |

Criteria for feeling
4: Softer than that of 100% silk fabric before processing
3: About equal to that of 100% silk fabric before processing
2: Somewhat harder than that of 100% silk fabric before processing
1: Harder than that of 100% silk fabric before processing As can be seen from results shown in Table 3, examples of the present invention are capable of imparting water repellency with dry cleaning resistance by treatment at a relatively low temperature of 80° C. or below. Feeling can be further softened by adding a silicone compound which has hitherto been believed to be incapable of adding due to deterioration in combined use with oil repellency without impairing oil repellency and other effects. The compositions of the present invention impart better overall properties to treated fabric than conventional compositions.

The various modifications and alterations of this invention will be apparent to those skilled in the art without departing from the scope and spirit of this invention and this invention should not be restricted to that set forth herein for illustrative purposes.

We claim:

1. A water- and oil-repellent treating agent for fibrous substrates comprising a fluorochemical water- and oil-repellent agent, an aziridine compound, and a metal alcoholate or ester, wherein the metal is aluminum, zirconium or titanium.

2. The treating agent of claim 1 wherein said aziridine compound is selected from the group consisting of β-aziridinylmethyl methacrylate, N-cyanoethylethyleneimine, octadecylethyleneurea, trimethylolpropanetris-[3-(1-aziridinyl)propionate], trimethylolpropanetris[3-(1-aziridinyl)butyrate], trimethylolpropane[3-(1-(2-methyl)aziridinyl)propionate], trimethylolpropanetris[3-(1-aziridinyl)-2-methyl propionate], pentaerythritoltris[3-(1-aziridinyl)-propionate], pentaerythritoltris[3-(1-(2-methyl)-aziridinyl)propionate], diphenylmethane-4,4'-bis N,N'-ethyleneurea, 1,6-hexamethylene-bis-N,N'-ethyleneurea, 2,4,6-(triethyleneimino)-syntriazine, bis[1-(2-ethyl)-aziridinyl]benzene-1,3-dicarboxylic acid amide, 1,6-hexamethylenediethyleneurea, diphenylmethanebis-4,-4'-N,N'-diethyleneurea, and 1,1,1-tris-(β-aziridinylpropionyloxymethyl)propane.

3. The treating agent of claim 1 wherein said metal alcoholate or ester is one which permits said treating agent to impart desired oil- and water-repellency to said fibrous substrate when said treating agent is applied to said fibrous substrate and dried at 90° C. or below.

4. The treating agent of claim 1 wherein said metal alcoholate or ester is selected from the group consisting of aluminum isopropylate, mono-sec-butoxyaluminum diisopropylate, aluminum sec-butyrate, aluminum ethylate, aluminum sec-butyrate stearate, zirconium butyrate, and zirconium propylate.

5. The treating agent of claim 1 wherein said aziridine is present at 1% to 20% by weight based on the weight of said fluorochemical and wherein said metal alcoholate or ester is present as 10% to 200% by weight based on the weight of said flurochemical.

6. The treating agent of claim 1 wherein said aziridine is present at 3% to 10% by weight based on the weight of said fluorochemical and wherein said metal alcoholate or ester is present at 20% to 100% by weight based on the weight of said fluorochemical.

7. The treating agent of claim 1 wherein said flurochemical comprises a copolymer of a fluoroaliphatic radical containing acrylate or methacrylate monomer, and an alkyl acrylate or methacrylate monomer.

8. The treating agent of claim 1 further comprising a silicone compound.

9. Method of treating fibrous substrate comprising:

A) contacting said fibrous substrate with a solution comprising a fluorochemical water- and oil-repellent agent, an aziridine compound, and a metal alcoholate or ester, wherein the metal is aluminum, zirconium;

B) drying the substrate resulting from step A.

10. The method of claim 9 wherein said drying is accomplished below 90° C.

11. The method of claim 9 wherein said drying is accomplished below 30° C.

12. The method of claim 9 wherein said aziridine is selected from the group consisting of β-aziridinylmethyl methacrylate, N-cyanoethylethyleneimine, octadecylethyleneurea, trimethylolpropanetris-[3-(1-aziridinyl)propionate], trimethylolpropanetris[3-(1-aziridinyl)butyrate], trimethylolpropane[3-(1-(2-methyl)aziridinyl)propionate], trimethylolpropanetris[3-(1-aziridinyl)-2-methyl propionate], pentaerythritoltris[3-(1-aziridinyl)-propionate], pentaerythritoltris[3-(1-(2-methyl)-aziridinyl)propionate], diphenylmethane-4,4'-bis-N,N'-ethyleneurea, 1,6-hexamethylene-bis-N,N'-ethyleneurea, 2,4,6-(triethyleneimino)-syntriazine, bis[1-(2-ethyl)-aziridinyl]benzene-1,3-dicarboxylic acid amide, 1,6-hexamethylenediethyleneurea, diphenylmethanebis-4,-4'-N,N'-diethyleneurea, and 1,1,1-tris-(β-aziridinylpropionyloxymethyl)propane.

13. The method of claim 9 wherein said metal alcoholate or ester is selected from the group consisting of aluminum isopropylate, mono-sec-butoxyaluminum diisopropylate, aluminum sec-butyrate, aluminum ethylate, aluminum sec-butyrate stearate, zirconium butyrate, and zirconium propylate.

14. The method of claim 9 wherein said aziridine is present at 1% to 20% by weight based on the weight of said flurochemical and wherein said metal alcoholate or ester is present as 10% to 200% by weight based on the weight of said fluorochemical.

15. The method of claim 9 wherein said aziridine is present at 3% to 10% by weight based on the weight of said fluorochemical and wherein said metal alcoholate or ester is present at 20% to 100% by weight based on the weight of said fluorochemical.

16. The method of claim 9 wherein said fluorochemical comprises a copolymer of a fluoroaliphatic radical containing acrylate or methacrylate monomer, and an alkyl acrylate or methacrylate monomer.

17. The method of claim 9 wherein said mixture further comprises a silicone compound.

18. Fibrous substrate treated with the treating agent of claim 1.

19. The fibrous substrate of claim 18 wherein said fibrous substrate is selected from the groups consisting of silk, wool, cotton, leather, hemp, rayon, and blends.

* * * * *